United States Patent [19]

Hovorka

[11] 4,124,110

[45] Nov. 7, 1978

[54] MAGNETIC COIN ELEMENT SENSOR

[75] Inventor: Jiri J. Hovorka, Muskogee, Okla.

[73] Assignee: Orin W. Coburn, Muskogee, Okla.

[21] Appl. No.: 708,120

[22] Filed: Jul. 23, 1976

[51] Int. Cl.[2] ..... G07F 3/02

[52] U.S. Cl. ..... 194/100 A; 194/1 N; 324/200

[58] Field of Search ..... 194/100 R, 100 A, 101, 194/1 N, 1 M, DIG. 3; 73/163; 324/41, 200; 209/81 R, 81 A

[56] References Cited

U.S. PATENT DOCUMENTS

| | | | |
|---|---|---|---|
| 1,839,874 | 1/1932 | Gottfried | 194/101 |
| 2,161,635 | 6/1939 | Prokopenko | 324/41 X |
| 2,390,147 | 12/1945 | Hatton | 194/101 |
| 2,891,112 | 6/1959 | Lamb et al. | 194/101 X |
| 3,065,412 | 11/1962 | Rosenthal | 324/41 |
| 3,837,454 | 9/1974 | Joeck | 194/100 A X |
| 3,933,232 | 1/1976 | Searle et al. | 194/100 A |
| 3,952,851 | 4/1976 | Fougere et al. | 194/100 A |
| 3,977,508 | 8/1976 | Baumberger | 194/100 A |

*Primary Examiner*—Joseph J. Rolla
*Attorney, Agent, or Firm*—Dunlap, Codding & McCarthy

[57] ABSTRACT

A magnetic coin element sensor for sensing, detecting and identifying coin elements and the like interposed in a magnetic field wherein the metallurgical structure of each interposed coin element causes an identifiable change in the magnetic field responsive to the metallurgical structure of the interposed coin element and uniquely indicative of the interposed coin element, the change in the magnetic field being sensed, detected and utilized to uniquely identify each of the interposed coin elements. The magnetic coin sensor is particularly useful for identifying coins deposited in a coin handling apparatus such as a vending machine, a coin telephone or the like.

17 Claims, 7 Drawing Figures

MAGNETIC COIN ELEMENT SENSOR

BACKGROUND OF THE INVENTION

1. Field of the Invention

This invention relates generally to improvements in coin handling apparatus and, more particularly, but not by way of limitation, to a magnetic coin element sensor for sensing, detecting and identifying coin elements and the like.

2. Description of the Prior Art

In the past various devices have been constructed for identifying monetary inputs deposited in a coin handling apparatus. Most of the devices constructed in the past have included apparatus for sensing and detecting the weight or the size of the deposited monetary element, and some have included apparatus for sensing and detecting the weight and the size of the deposited monetary element each type of apparatus being constructed in an effort to uniquely identify the monetary value and the genuineness of the deposited monetary element thereby reducing the possibility of the coin handling apparatus accepting a counterfeit coin element or the like.

Some of the coin handling apparatus constructed in the past have also included various devices for totalizing the monetary value of various deposited coin elements and providing some form of output indication of the totalized monetary value. In some instances, the operation of the totalizing apparatus was dependent upon the deposited monetary element being initially identified and the genuineness thereof verified prior to the actuation of the totalizing apparatus to provide the output signal indicative of the totalized monetary value. Most of the devices, including the totalizing apparatus, constructed in the past have included a large number of parts, assemblies and cooperating mechanical and electrical interconnections therebetween thereby substantially increasing the required maintenance and the possibility of a malfunction of the coin handling apparatus. Related prior art apparatus are shown in the following U.S. Pat. Nos. 649,737; 2,250,047; 2,390,147; 3,373,856; 3,599,771; and 3,682,286.

SUMMARY OF THE INVENTION

An object of the invention is to provide a coin element sensor which is more reliable and substantially maintenance free in the operation thereof.

One other object of the invention is to provide an improved coin element sensor substantially reducing the possibilities of a malfunction.

A still further object of the invention is to provide an improved coin element sensor method and apparatus uniquely identifying coin elements in a manner substantially independent of the diameter, the width and the weight of the coin element.

Another object of the invention is to provide an improved coin element sensor method and apparatus substantially decreasing the probability of accepting counterfeit coins.

Yet another object of the invention is to provide an improved coin element sensor method and apparatus which can be calibrated to detect, sense and identify a substantially large variety of deposited coin elements in a faster, more efficient, more accurate and more economical manner.

A still further object of the invention is to provide an improved coin element sensor method and apparatus for identifying the genuineness and monetary denomination of the deposited coin elements in a faster, more efficient, more accurate and more economical manner.

A further object of the invention is to provide an improved coin element sensor method and apparatus capable of being preprogrammed to sense, detect and identify a large variety of deposited coin elements and totalize the deposited coin elements in accordance with a predetermined preprogram in a faster, more accurate, more economical and more efficient manner.

Another object of the invention is to provide a coin element sensor method and apparatus which can be programmed to sense, detect and identify various forms of domestic (United States of America) and foreign currencies, in a faster, more economical, more accurate and more efficient manner.

One further object of the invention is to provide an improved coin element sensor for sensing, detecting and identifying deposited coin elements having a reduced number of parts and assemblies thereby substantially reducing the required maintenance and the possibility of a malfunction.

One further object of the invention is to provide an improved coin element sensor method and apparatus which is economical in the construction and the operation thereof.

Other objects and advantages of the invention will be evident from the following detailed description when read in conjunction with the accompanying drawings which illustrate a preferred embodiment of the invention.

DESCRIPTION OF THE PREFERRED EMBODIMENT

Figure 1:
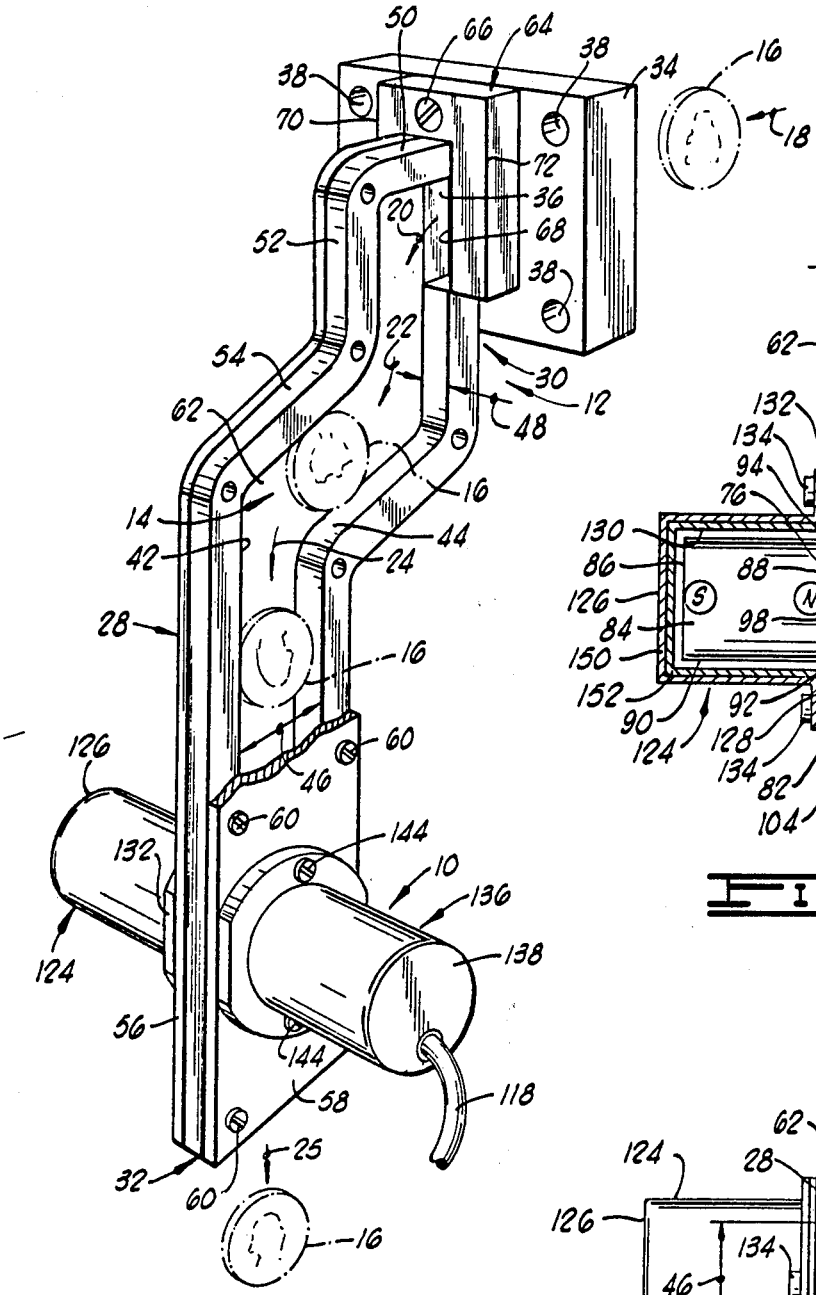
FIG. 1 is a perspective, partially cut-away, diagrammatical view of a portion of the coin sensor assembly of the present invention connected in an operating position to the coin receiving assembly of the present invention, a typical coin element being diagrammatically shown in dashed-lines at various positions in a coin receiving path.
Figure 2:
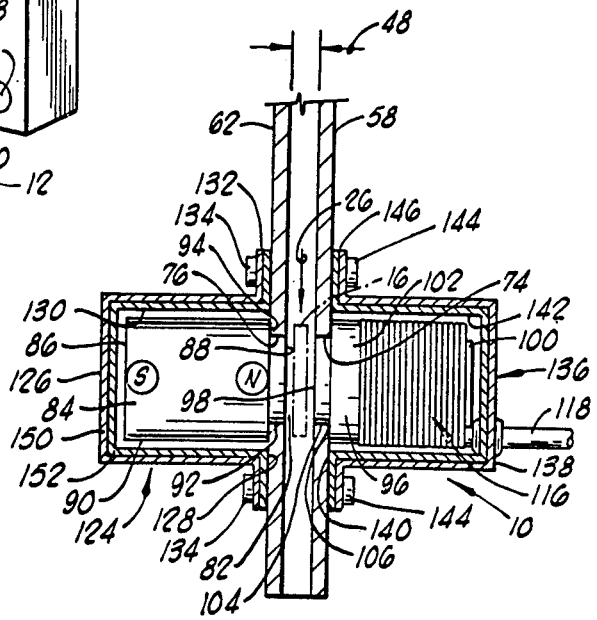
FIG. 2 is a partial cross-sectional, partial elevational, enlarged view of the coin sensor assembly of FIG. 1, showing a fragmentary portion of the coin receiving assembly and a typical coin element, the coin element being shown in dashed-lines.

Referring to the drawings in general, and to FIG. 1 in particular, shown therein and designated via the general reference numeral 10 is a coin sensor assembly connected in an operating position to a portion of a coin receiving assembly 12, the coin receiving assembly 12 having a coin path opening 14 formed therethrough and extending between portions of the coin sensor assembly 10 for receiving and guiding coin elements and the like (various coin elements being diagrammatically shown in dashed-lines in FIG. 1 at various positions and each of the coin elements being designated via a general reference numeral 16 for the purpose of clarity of description) into and through the coin path opening 14 during the operation of the method and apparatus of the present invention, the travel of the coin elements 16 being diagrammatically indicated via directional arrows 18, 20, 22, 24, 25 and 26, as shown in FIGS. 1 and 2 (the coin path opening 14 being referred to herein simply as the "coin path 14"). In general, the coin sensor assembly 10 is connected to the coin receiving assembly 12 such that the coin path 14 guides the coin elements 16 through a predetermined portion of the coin sensor assembly 10 and the con sensor assembly 10 is constructed to sense, detect and uniquely identify the monetary value and the genuineness of each of the coin elements passing therethrough, the coin sensor assembly 10, more particularly, producing an output signal uniquely identifying the interposed, deposited coin element, in a manner which will be described in greater detail below.

Although the method and the apparatus of the present invention are described herein and illustrated in the drawings as being utilized in connection with a coin handling type of apparatus, it should be particularly noted that the term "coin elements", including the corresponding diagrammatical illustrations thereof and references thereto in the drawings, and the term "coin" as utilized herein to identify various components and assemblies such as the "coin sensor assembly 10", the "coin receiving assembly 12", the "coin path 14", and the "coin element 16", for example, are utilized herein for the purpose of clarity of description and identification. It is to be specifically understood that the method and the apparatus of the present invention are not limited to any particular type of elements or coins nor is the method and apparatus of the present invention limited to sensing, detecting and uniquely identifying the monetary value and genuineness of coin type elements. Rather, the method and the apparatus of the present invention, more generally, are utilized, constructed and adapted to identify any element having a material composition of a nature such that the element, when interposed in a magnetic field, produces an identifiable change in the magnetic field indicative of the material composition of the element, the method and the apparatus of the present invention being utilized to sense, detect and identify the elements interposed in the magnetic field via the change in flux density produced via the interposed element. The method and the apparatus of the present invention are described herein with respect to a coin handling apparatus type of application since the method and the apparatus of the present invention are particularly suitable for sensing, detecting, verifying and uniquely identifying a coin type of element deposited in a coin handling apparatus such as a vending machine, a coin operated telephone or other similar type of coin receiving and handling apparatus, for example, in a manner to be described in greater detail below.

Figure 3:
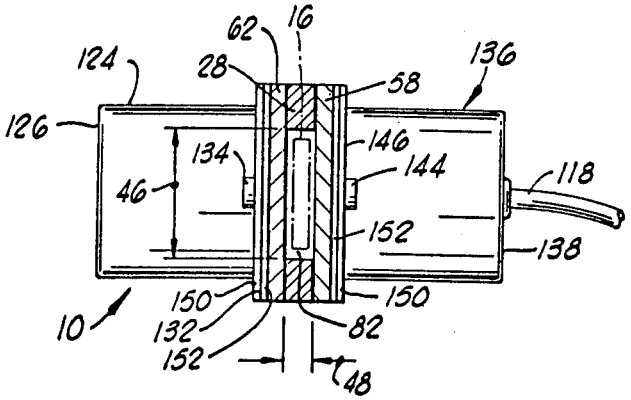
FIG. 3 is a partial cross-sectional, partial elevational plan view of the coin sensor assembly and the coin receiving assembly of FIGS. 1 and 2, a typical coin element being shown in dashed-lines.

Referring more particularly to the coin receiving assembly 12, as shown in FIGS. 1, 2 and 3, the coin receiving assembly 12 includes a housing 28 having a coin receiving end portion 30 and a coin exit end portion 32. A flange 34 is formed on a portion of the coin receiving end 30 of the housing 28, the flange 34 having a coin receiving slot 36 formed through a central portion thereof and a plurality of openings 38 formed therethrough generally near the outer periphery thereof. The coin receiving slot 36 has a width and a length sized to permit the passing of the coin element, such as the coin element 16, having the largest diameter and the largest width with respect to the predetermined coin elements to be received via the coin receiving assembly 12, the coin receiving slot 36 being positioned through the flange 34 such that the coin receiving slot 36 intersects and communicates with a portion of the coin path 14 permitting coin elements to be disposed within the coin path 14 via the coin receiving slot 36. The openings 38 (three openings 38 being shown in FIG. 1) are sized and located on the flange 34 to accommodate the attachment of the coin receiving assembly 12 and the coin sensor assembly 10 connected thereto to a coin handling apparatus such as a vending machine, a coin operated telephone or the like, for example.

As shown in FIG. 1, the coin path 14 is, more particularly, formed through a central portion of the housing 28 and extends through the entire length of the housing 28, generally between the coin receiving end 30 and the coin exit end 32 thereof. The coin path 14 forms a pair of walls 42 and 44 disposed in a generally parallel relationship along the length of the housing 28 between the coin receiving end 30 and the coin exit end 32 thereof, the walls 42 and 44 being spaced apart a predetermined distance 46 and having a width 48 substantially the same as the width of the housing 28 through which the coin path is formed. The spacing or distance 46 between the walls 42 and 44 and the width 48 of the walls 42 and 44 (only the width 48 of the wall 44 being shown in FIG. 1) form two of the dimensions of the coin path 14, the distances sometimes being referred to herein as the coin path length 46 and the coin path width 48. It should be noted that, in a preferred form and as shown in the drawings, the coin path 14 does not extend through the housing 28 in a straight line and the distance between the walls 42 and 44 generally near the turns or bends in the coin path 14 is formed on a radius and is slightly larger with respect to the distance 46 of the generally straight extending housing 28 portions to accommodate the traveling of the coin elements through the coin path 14 during the operation of the method and apparatus of the present invention, as will be made more apparent below.

The housing 28 includes a first portion 50 extending a distance generally perpendicularly from the flange 34, a second portion 52 extending generally perpendicularly from the first portion 50, a third portion 54 extending a distance generally perpendicularly from the second portion 52 and being disposed generally parallel to the first portion 50, and a fourth portion 56 extending generally perpendicularly from the third portion 54 and generally parallel with the second portion 52, the second housing portion 52 and the fourth housing portion 56 being disposed in a relatively vertically extending position when the coin receiving assembly 12 is secured to a coin handling apparatus to facilitate the "free falling" of the coin elements through the coin path 14. More particularly, the first portion 50 extends a predetermined distance from the coin receiving slot 36 formed in the flange 34 such that the portion of the coin path 14 formed through the first and the second portions 50 and 52 of the housing 28 provide a sufficient space for receivingly accepting the largest diameter coin element deposited within the coin path 14 via the coin receiving slot 36 and such that the largest diameter and the smallest diameter coin element disposed within the coin path 14 via the coin receiving slot 36 are directed and guided in a direction generally transverse to the coin receiving slot 36 as indicated via the directional arrow 20, thereby guidingly directing each of the received coin elements generally into engagement with a portion of the wall 44 formed through the third housing portion 54 prior to guiding the deposited coin elements into the portion of the coin path 14 formed in the fourth housing portion 56. The third housing portion 54 extends a sufficient distance from the second housing portion 52 such that the portions of the coin path 14 formed through the second and third housing portions 52 and 54 cooperate with the portions of the coin path 14 formed through the first and the second housing portions 50 and 52 to guide each of the deposited coin elements into engagement with the wall 44 portion formed in the third housing portion 54 prior to the deposited coin element being guided through the portion of the coin path 14 formed through the fourth housing portion 56, for reasons which will be made more apparent below.

Thus, the housing portions 50, 52, 54 and 56 and the portions of the coin path 14 formed therethrough are shaped, constructed and positioned such that a coin element deposited through the coin receiving slot 36 will be guided in a vertically downwardly direction toward engagement with the wall 44 portion formed in the third housing portion 54 in a general direction indicated via the directional arrow 20; the coin element will then engage a portion of the wall 44 formed in the third housing portion 54 and be guided and directed therealong into the portion of the coin path 14 formed in the fourth housing portion 56 in a direction generally indicated via the directional arrows 22 and 24; and the deposited coin element then falls through the coin path 14 formed in the fourth housing portion 56 and between portions of the coin sensor assembly 10, the coin element subsequently exiting from the coin receiving assembly 12 in a direction generally indicated via the directional arrow 25 in FIG. 1. Since each of the deposited coin elements are initially forced into engagement with the wall 44 formed in the third housing portion 54, the velocity and force with which the coin element is initially inserted in a general direction 18 through the coin receiving slot 36 will not affect the operation of the coin sensor assembly 10, each deposited coin element engaging the wall portion 44 of the third housing portion 54 and rolling in general directions 22 and 24 into and through the coin path 14 portion interposed between segments or portions of the coin sensor assembly 10, as will be described in greater detail below.

As shown in FIG. 1, a cover plate 58 is secured to one side of the housing 28 via fastener elements (three of the fastener elements being shown in FIG. 1 and designated therein via the general reference numeral 60) and a cover plate 62 is secured to the opposite side of the housing 28 with respect to the cover plate 58, the cover plate 62 also being secured to the housing 28 via a plurality of fasteners (not shown). Each cover plate 58 and 62 extends along the entire length of the housing 28 generally between the coin receiving end 30 and the coin exit end 32 thereof, a portion of each cover plate 58 and 62 covering and substantially enclosing a portion of the coin path 14. Thus, the coin path 14 is encompassed via a portion of each of the cover plates 58 and 62 and the walls 42 and 44 formed through the housing 28, the walls 42 and 44 and the portions of the cover plates 58 and 62 extending over the coin path 14 each cooperating to form the coin path 14 through the housing 28 and provide guiding surfaces guidingly moving and directing each of the deposited coin elements along a predetermined coin path through the housing 28 (the housing 28 and the cover plates 58 and 62 being sometimes generally referred to herein as the housing).

The housing 28, including the flange 34 formed thereon, and the cover plates 58 and 62 are each constructed of a non-ferrous material or an elastomeric, plastic type of material, for reasons which will be made more apparent below.

A coin entry detector 64 is secured to the flange 34 via a fastener 66, the coin entry detector 64 having a slot 68 formed therethrough and intersecting one end thereof forming a pair of legs 70 and 72 spaced a distance apart via the slot 68 (only a portion of the leg 70 being shown in FIG. 1). The slot 68 is, more particularly, sized to receive a portion of the first housing portion 50, generally near the coin receiving end 30 of the housing 28. The first housing portion 50 is thus disposed generally within the slot 68 of the coin entry detector 64 and the leg 70 of the coin entry detector 64 is disposed generally on one side of the first housing portion 50, the leg 72 being disposed generally on the opposite side of the first housing portion 50.

The coin entry detector 64 is constructed of a permanent magnet material and, as shown in FIG. 1, portions of the coin entry detector 64 generally surround a portion of the coin path 14, generally adjacent the coin receiving slot 36, thereby surrounding a substantial portion of the coin receiving slot 36 via a permanent magnet material. During the operation of the coin sensor assembly 10 and coin receiving assembly 12, the coin entry detector 64 functions to detect steel slugs and the like deposited through the coin receiving slot 36, the coin entry detector 64 substantially preventing the depositing of the steel slugs and the like into the coin path 14.

As shown more clearly in FIG. 2, an opening 74 is formed through the cover plate 58 and an opening 76 is formed through the cover plate 62, the openings 74 and 76 each being substantially aligned and intersecting a portion of the coin path 14 such that communication is provided therebetween via the portion of the coin path 14 disposed between the openings 74 ad 76. As shown more clearly in FIGS. 2 and 3, the coin sensor assembly 10 includes one portion disposed and supported generally within the opening 74 through the cover plate 58 and one other portion disposed and supported generally within the opening 76 through the cover plate 62, a portion of the coin sensor assembly 10 being thus disposed and supported such that a portion 82 of the coin path 14 extends through a portion of the coin sensor assembly 10.

More particularly, the coin sensor assembly 10 is constructed and disposed to establish a magnetic field generally within the coin path portion 82 extending therethrough, and the coin sensor assembly 10 and the coin path 14 are each constructed and positioned such that the coin path 14 guides each of the deposited coin elements through the coin sensor assembly magnetic field. The coin sensor assembly 10 is further constructed such that the interposing of a coin element in the magnetic field established in the coin path portion 82 causes a change in the magnetic field producing an identifiable flux density change uniquely indicative of the metallurgical structure or composition of the interposed coin element, the coin sensor assembly 10 sensing and detecting the flux density change caused by the interposed coin element and producing an output indication indicative thereof for uniquely identifying the deposited coin element, in a manner to be described in greater detail below.

The coin sensor assembly 10 includes a permanent magnetic 84 having opposite ends 86 and 88 and an outer periphery 90, the permanent magnet 84 being constructed and positioned with respect to the polarity thereof such that the end portion 86 forms the south pole and the end portion 88 forms the north pole (the ends 86 and 88 being sometimes referred to herein as the "south pole end portion 86" and the "north pole end portion 88"). A recess 92 is formed in the north pole end portion 88 and extends about the periphery 90 of the permanent magnet 84 forming an annular wall 94, the recess 92 being sized and shaped to substantially correspond to the size and shape of the opening 76 formed through the cover plate 62 of the housing 28. In an assembled position, as shown in FIG. 2, the opening 76 through the cover plate 62 is sized to receive the north pole end portion 88 of the permanent magnet 84, the north pole end portion 84 being inserted through the opening 76 to a position wherein the annular wall 94 engages portions of the cover plate 62 generally near and adjacent the opening 76 limiting the movement of the permanent magnet 84 in a direction through the opening 76 and positioning the permanent magnet 84 in an assembled position extending generally transversely to the coin path portion 82. In this position, the north pole end portion 88 of the permanent magnet 84 is disposed generally adjacent and extends generally parallel to the coin path portion 82.

The coin sensor assembly 10 also includes a pole extension magnet 96 having opposite ends 98 and 100 and an outer periphery 102. A recess 104 is formed in the end 98 of the pole extension magnet 96 and extends about the outer periphery 102 thereof forming an annular wall 106, the recess 104 being sized and shaped to substantially correspond to the size and the shape of the opening 74 formed through the cover plate 58. In an assembled position of the pole extension magnet 96, shown more clearly in FIG. 2, the end 98 of the pole extension magnet 96 is inserted through the opening 74 to a position wherein the annular wall 106 abuts portions of the cover plate 58 generally adjacent the opening 74 therethrough, thereby positioning the pole extension magnet 96 in an assembled position extending generally transversely to the coin path portion 82 such that the end 98 thereof is disposed generally adjacent and extends generally parallel to the coin path portion 82.

Thus, in an assembled position of the permanent magnet 84 and the pole extension magnet 96, the north pole end portion 88 of the permanent magnet 84 is aligned with the end 98 of the pole extension magnet 96, and the north pole end portion 88 is spaced a predetermined distance corresponding to the coin path width 48 from the end 98, the aligned ends 88 and 98 each extending generally parallel to the coin path portion 82 and the spacing 48 between the ends 88 and 98 forming the coin path portion 82 extending through the coin sensor assembly 10.

The permanent magnet 84 and the pole extension magnet 96 each have a generally circularly or rectangularly shaped cross-section, in one preferred embodiment, the length of the north pole end portion 88 of the permanent magnet 84 and the length of the end 98 of the pole extension magnet 96 each being, more particularly, referred to as a diameter in those applications wherein the permanent magnet 84 and the pole extension magnet 96 have generally circularly shaped cross-sections. In any event, the cross-sectional area of the north pole end portion 88 of the permanent magnet 84 and the cross-sectional area of the end 98 of the pole extension magnet 96 are each substantially at least as large as the cross-sectional area of the largest cross-sectional area coin element to be received via the coin receiving assembly 12 and sensed, detected and identified via the coin sensor assembly 10 in any particular, predetermined operational embodiment of the present invention. Further, the coin path width 44 and length 46 are each sized such that the largest width and the largest diameter coin element to be received via the coin receiving assembly 12 and sensed and detected via the coin sensor assembly 10 in any particular, predetermined operational embodiment of the present invention falls freely through the coin path 14. For example, assuming the coin receiving assembly 12 and the coin sensor assembly 10 are each constructed to receive coins of United States currency in monetary denominations of pennies, nickels, dimes and quarters, the coin path 14 and the coin path portion 82 are each sized to permit the passing of the largest diameter and the largest width coin element (pennies, nickels, dimes and quarters) and the cross-sectional area of the north pole end portion 88 of the permanent magnet 84 and the cross-sectional area of the end 98 of the pole extension magnet 96 are each sized to be at least as large as the cross-sectional area of the largest cross-sectional area coin element or, in other words, a United States Quarter in those applications where the coin receiving assembly 12 and the coin sensor assembly 10 are constructed to receive coin elements of United States currency having denominations of pennies, nickels, dimes and quarters, for example.

In a preferred form, the magnet 96 is constructed of a material having optimum pole extension magnetic capabilities with respect to a particular operational application of the coin sensor assembly 10, the magnetization of the pole extension magnet 96 being changed via a change of the coin sensor assembly magnetic field established in the coin path portion 82. In one preferred form, the pole extension magnet 96 is constructed of a relatively low carbon iron which is heat treated to remove substantially all of the carbon interference, the low carbon iron being of the type identified in the art as S.A.E. 1010, for example.

As shown more clearly i FIG. 2, a sensor coil 116 is disposed and securedly positioned about a peripheral portio of the pole extension magnet 96, generally near the end 100 thereof. The sensor coil 116 has a predetermied number of ampere-turns of insulated coil wire conductors extending peripherally about the pole extension magnet 96, the sensor coil 116 conductors being constructed of insulated nickel wire in one preferred embodiment. The insulated conductors of the sensor coil 116 are disposed within an insulated cable 118 for connection of the sensor coil output signal to various indicator devices or control networks, for reasons and in a manner to be made more apparent below.

The portions of the permanent magnet 84 extending transversely from the housing 28, or more particularly, the cover plate 62, are encompassed via a casing 124, the casing 124 being generally cylindrically shaped (in one form) having a closed end 126, an open end 128 formed via a casing opening 130 extending a distance through the open end 128. A flange 132 is formed about the outer periphery of the open end 128 of the casing 124 and extends a distance generally radially therefrom, the casing 124 being secured in an assembled position to the cover plate 62 via a plurality of fasteners 134 extending through the flange 132, as shown in FIG. 2. In an assembled position, the casing 124 is secured to the cover plate 62 of the housing 28 generally near the opening 76 and the south pole portion 86 of the permanent magnet 84 is disposed generally within the casing opening 130, the casing 124 and the casing opening 130 are constructed such that, in an assembled position, the casing 124 encompasses the portions of the permanent magnet 84 extending transversely from the cover plate 62 of the housing 28, for reasons to be described in greater detail below.

A cylindrically shaped casing 136 having a closed end 138, an open end 140 and a casing opening 142 extending a distance therethrough intersecting the open end 140 thereof is secured to the cover plate 58 of the housing 28 via a plurality of fastener elements 144 extending through a flange 146 formed about the outer periphery of the casing 136 generally near the open end 140, the flange 146 extending a distance radially from the casing 136. The casing 136 is thus constructed similar to the casing 124 and, in an assembled position, the casing 136 is secured to the cover plate 58 generally near the opening 74 therethrough. A portion of the pole extension magnet 96 is disposed within the casing opening 142 of the casing 136, the casing 136 and the casing opening 142 each being sized and constructed such that the casing 136 encompasses the portions of the pole extension magnet 96 extending transversely from the cover plate 58 of the housing 28. An aperture (not shown) is formed through the closed end 138 of the casing 136 for accommodating the insulated cable 118 extending therethrough.

The casings 124 and 136 each provide a positive electromagnetic shield for the portions of the coin sensor assembly 10 encompassed thereby. In one preferred form, the casings 124 and 136 each include an outer casing 150 constructed of a drawn nickel material, for example, and an inner casing 152 formed about the inner peripheral surface of each of the casings 124 and 136 formed via the casing openings 130 and 142, respectively. The inner casings 152 are constructed of a copper-nickel material plated on the outer casings 150 in increments of 0.001 per inch up to 10 (10) laminations. in one preferred form. The nickel drawn outer casings 150 and the copper-nickel plated laminations forming the inner casings 152 each provide a positive electromagnetic shield construction for the casings 124 and 136. The electromagnetic shield formed via the casing 124 and 136 are each grounded via leads attached to the last copper-nickel lamination of the respective inner casings 152 (not shown).

An element or composition of elements exhibits specific, identifiable electrical and magnetic properties or, in other words, the specific metallurgical structure of an object or coin element causes the coin element to exhibit specific, identifiable electrical and magnetic properties. When such a coin element or the like is interposed in an existing, external magnetic field, energy is absorbed via the interposed coin element or the like as a function of the particular distinct metallurgical composition of the interposed coin element. The interposed coin element or the like will thus influence or change the magnetic field properties, the specific change being a function of the distinct, identifiable metallurgical composition of the interposed coin element. More particularly, the coin element or the like increases or decreases the flux density of the externally created magnetic field as a function of the distinct metallurgical composition of the interposed coin element resulting largely from the amount of energy absorbed via the interposed coin element, including the metallurgical permeability of the interposed coin element. The flux density change in the magnetic field between the permanent magnet 84 and the pole extension magnet 96 occurs as a result of increasing or decreasing the electric charge in the coin element passing therethrough.

Referring more particularly to the coin sensor assembly 10 of the present invention, a magnetic field having a substantially constant magnetic field strength and flux density is established between the permanent magnet 84 and the pole extension magnet 96 generally within the coin path portion 82 extending therebetween. Assuming an initial or starting position wherein coin elements are not interposed in the coin path portion 82, the flux linking the sensor coil 116 will be constant and the output voltage signal of the sensor coil 116 will be substantially zero.

When a coin element is deposited in the coin receiving assembly 12 and guided through the coin path 14 to a position wherein the deposited coin element is interposed in the magnetic field established via the coin sensor assembly 10 or, in other words, when the deposited coin element is positioned within the coin path portion 82 between the permanent magnet 84 and the pole extension magnet 96, the flux density of the coin sensor assembly magnetic field will be changed via the interposed coin element, the particular amount of flux density change being indicative of and responsive to the metallurgical structure of the interposed coin element. The flux density change will result in a specific change of the flux linking the sensor coil 116 thereby inducing an electromotive force (emf) in the sensor coil 116. The induced electromotive force or induced voltage in the sensor coil 116 is detectable as the sensor coil output signal and is uniquely indicative of the metallurgical structure of the interposed coin element thereby being uniquely indicative of a particular, interposed coin element.

The cross-sectional area of the north pole end portion 88 of the permanent magnet 84 and the crosssectional area of the end 98 of the pole extension magnet 96 are at least as large as the cross-sectional area of the predetermined largest cross-sectional area coin element to be sensed, detected and identified via the coin sensor assembly 10, as mentioned before. Thus, the entire crosssectional area of each coin element, predetermined to be received via the coin receiving assembly 12 and sensed and identified via the coin sensor assembly 10, will be positioned within the magnetic field of the coin sensor assembly 10 between the permanent magnet 84 and the pole extension magnet 96, each coin element being thus positioned to exert a maximum influence on the coin sensor assembly magnetic field in this position thereby assuring the induced sensor coil output signal is indicative of the maximum influence of each coin element passing through the coin sensor assembly 10.

Figure 4:
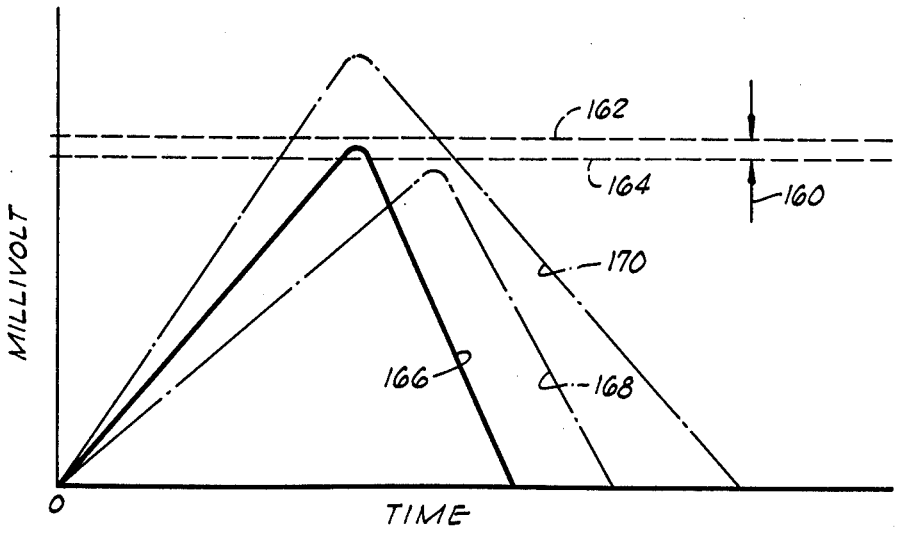
FIG. 4 is a diagrammatical view illustrating the construction and operation of a tolerance band established using the coin sensor assembly output signals of the present invention, FIG. 4 further illustrating the calibration of the coin sensor assembly of the present invention for sensing, detecting and identifying predetermined coin elements.

Since each predetermined coin element will change the flux density of the coin sensor assembly magnetic field producing a distinct, identifiable coin sensor assembly output voltage signal via the conductors of the sensor coil 116, the coin sensor assembly 10 of the present invention produces an output signal uniquely identifying the coin element sensed and detected thereby. Thus, a relatively narrow tolerance voltage band or, more simply, the tolerance band defined via a maximum and a minimum voltage level output signal of the sensor coil 116 can be established for each particular, predetermined coin element to be detected and sensed via the coin sensor assembly 10 in any particular predetermined operational embodiment of the present invention. Thus, assuming the coin receiving assembly 12 and the coin sensor assembly 10 are each constructed to receive, detect, sense and identify predetermined, accepted coin elements having a sensor coil 116 output voltage signal within a predetermined tolerance band 160 defined via a maximum voltage level 162 and a minimum voltage level 164, as diagrammatically shown in FIG. 4, when a coin element producing a coin sensor assembly output signal 166 with a maximum or peak voltage level falling within the predetermined tolerance band 160 is received via the coin receiving assembly 12 and sensed and detected via the coin sensor assembly 10, the presence of the maximum voltage level of the coin sensor assembly output signal 166 is detected and the deposited coin element is identified and determined to be of the predetermined accepted type of coin element. By the same token, when coin elements having coin sensor assembly output signals 168 and 170 (FIG. 4) with maximum or peak voltage levels falling outside the established, predetermined tolerance band 160 are received via the coin receiving assembly 12 and sensed and detected via the coin sensor assembly 10, the presence of the maximum voltage levels of the coin sensor assembly output signals 168 and 170 are detected and the deposited coin elements are identified and determined to be of a type other than the predetermined accepted type of coin element.

Further, a particular operational embodiment of the present invention can be preprogrammed to accept a predetermined number of coin elements utilizing the established, predetermined tolerance band of each coin element to be accepted for uniquely identifying each deposited coin element received and detected via the coin sensor assembly 10. For example, the apparatus of the present invention can be preprogrammed in one operational embodiment to accept United States coin elements of penny, nickel, dime and quarter denominations utilizing the established, predetermined tolerance bands for the penny, the nickel, the dime and the quarter to uniquely identify each coin element. In this example, the apparatus of the present invention may also include a counter-totalizer network or the like to provide an output signal indicative of the total monetary value of the various deposited coin elements. In any event, the apparatus of the present invention provides an electrical output signal uniquely indicative of the sensed and detected coin element which is independent of the size and the weight of the predetermined, accepted types of coin elements in the sense that the coin sensor assembly 10 does not measure or indicate the weight and the size of a coin element and utilize the measured size and weight to determine the validity or genuineness of subsequently deposited coin elements.

For example, referring to FIG. 5, various alternating-current voltages representing the coin sensor assembly output signal (expressed in millivolts) are shown for nine different coin elements, the nine coin elements being described in TABLE I below, including the weight of each coin element (expressed in grams) and the differential of each coin element with respect to the weight of the coin element No. 1, a United States Quarter.

TABLE I

| Coin Element | Coin Element Description | Coin Element Weight (grams) | Differential Coin Element Weight as Compared to Coin Element No. 1 |
|---|---|---|---|
| No. 1 | U.S. Quarter | 5.68082 | —0— |
| No. 2 | U.S. Silver Quarter | 6.20046 | +0.51964 |
| No. 3 | Fake Quarter | 5.52877 | −0.15205 |
| No. 4 | Mexican Coin | 5.41353 | −0.2672 |
| No. 5 | Brass with Lead Alloy | 4.83911 | −0.84171 |
| No. 6 | Berilium-Copper Alloy | 6.32558 | +0.64476 |
| No. 7 | Brass Alloy | 6.10065 | +0.41983 |
| No. 8 | Aluminum Alloy | 2.30150 | −3.37932 |
| No. 9 | Lead Alloy | 8.25514 | +2.57432 |

Figure 5:
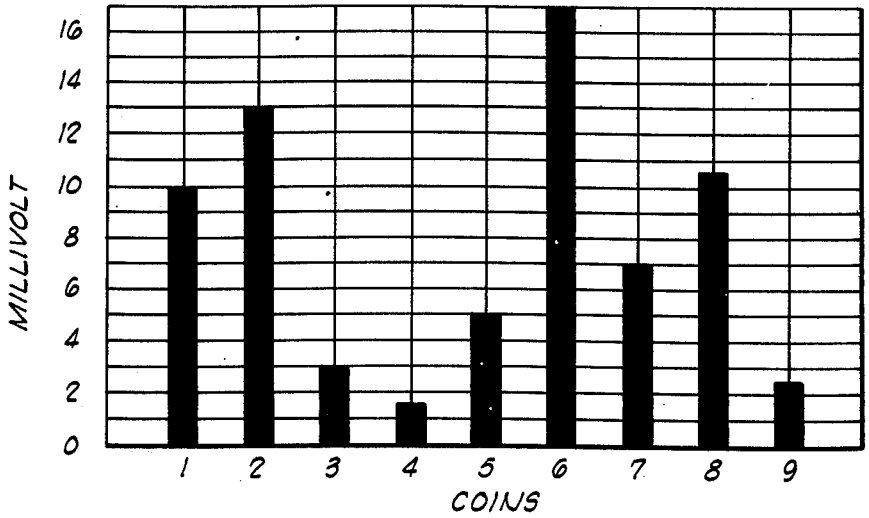
FIG. 5 is a view of a chart showing the coin sensor assembly output signal in millivolts for nine different deposited coin elements in one operational example of the coin element sensor assembly of the present invention.

From the above chart indicating the weight (expressed in grams) and the weight differential (expressed in grams) of each of the nine coins with respect to the U.S. Quarter, coin No. 1, it will be observed from FIG. 5 of the drawings that each of the coin elements, Nos. 1 through 9, produced a distinct alternating-current voltage output signal (expressed in millivolts) at the sensor coil 116 output terminals. Thus, it may be established that there is an identifiable distinction between the various materials passing between the permanent magnet 84 and the pole extension magnet 96, a distinction producing an identifiable, distinct output signal at the sensor coil 116 output terminals uniquely indicative of each coin element passing through the coin sensor assembly 10 of the present invention. In those instances where the variations in the alternating-current output voltages for the various metallurgical coin element compositions to be sensed and detected via the coin sensor assembly 10 are relatively small, such distinctions can be enhanced by incorporating an amplifier in the coin sensor assembly control network (to be described with respect to one operational embodiment below). From the foregoing it is observed that a relatively narrow tolerance band defined via a maximum and a minimum voltage level output signal of the sensor coil 116 can be established for each particular, predetermined coin element to be detected and sensed via the coin sensor assembly 10 in any particular predetermined operational embodiment of the present invention, such as a United States quarter type of coin element, for example.

DESCRIPTION OF FIG. 6

Figure 6:
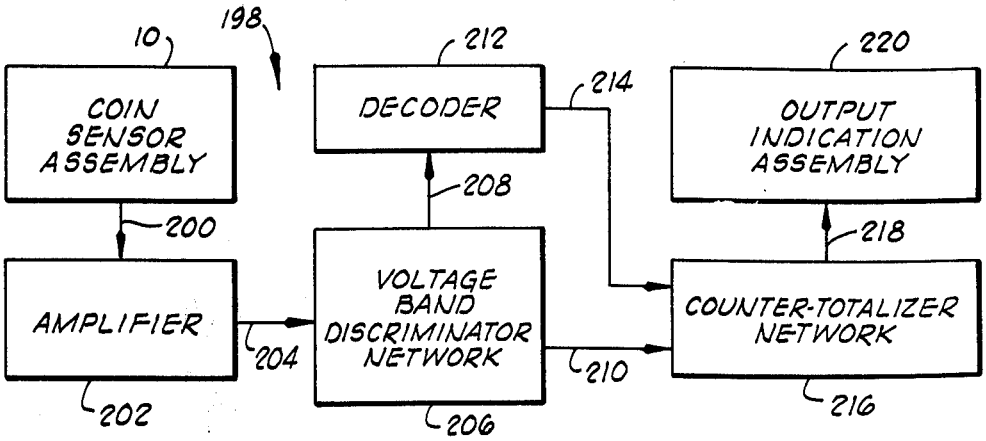
FIG. 6 is a diagrammatical view of the coin sensor assembly of the present invention connected to a coin sensor control network for identifying each deposited coin element and providing an output indication of the total monetary value of the sensed, detected, identified and verified deposited coin elements.

In one operational embodiment of the coin sensor assembly 10 and coin receiving assembly 12, diagrammatically shown in FIG. 6, the coin sensor assembly 10 provides an output signal (the induced voltage output signal of the sensor coil 116) via a signal path 200 that is connected to an amplifier network 202, the amplifier network 202 amplifying the received coin sensor assembly output signal and providing an amplified signal via a signal path 204. The amplified signal is connected to and received by a voltage band discriminator network 206, via the signal path 204, the voltage band discriminator network 206 being constructed to detect the peak or maximum voltage level of the received amplified signal and to provide an output valid signal via a signal path 208 when the received amplified signal has a voltage level within a given, predetermined tolerance band or, in other words, a peak voltage level generally between a predetermined maximum voltage level and a predetermined minimum voltage level. The voltage band discriminator network 206, in a preferred form, is also constructed to provide an output invalid signal via a signal path 210 when the received amplified signal has a voltage level outside the predetermined tolerance band or, in other words, when the received amplified signal has a voltage level above the predetermined maximum voltage level or below the predetermined minimum voltage level establishing the tolerance band of the coin sensor assembly 10.

The output valid signal is connected to and received by a decoder network 212 via the signal path 208, the decoder network 212 being constructed to provide an output signal via the signal path 214 uniquely indicative of and identifying the sensed and detected coin element or object producing the coin sensor assembly output signal. A counter-totalizer network 216 receives the decoder output signal via the signal path 214 and the voltage band discriminator network output invalid signal via the signal path 210, the counter-totalizer network 216 being disenabled upon receiving the output invalid signal indicating an object or coin element has been deposited and interposed in the magnetic field of the coin sensor assembly 10 producing a sensor coil 116 output signal and amplifier output signal having a voltage level above or below the predetermined tolerance band of acceptability of the voltage band discriminator network 206. Thus, when an object or a coin element is deposited and interposed in the magnetic field the coin sensor assembly 10 which produces a sensor coil output signal having a voltage level not corresponding to the predetermined acceptable voltage levels identifying predetermined acceptable coin elements, the counter-totalizer network 216 is disenabled and the apparatus of the present invention will not provide an output indication or, more particularly, will provide an output indication indicating that a coin element or object has been interposed in the magnetic field of the coin sensor assembly 10 of a type predetermined to be not acceptable.

The counter-totalizer network 216 is also constructed to receive the decoder output signal via the signal path 214, as indicated before, and to provide a counter-totalizer network output signal via a signal path 218 indicative of the decoder output signal or signals received via the counter-totalizer network during a predetermined operational period of time. More particularly, should four coin elements, for example, be sequentially interposed in the magnetic field of the coin sensor assembly 10, each producing a separate decoder output signal, the counter-totalizer network 216 is constructed to receive each of the four decoder output signals and to provide a counter-totalizer network output signal indicative of the total monetary value of the four received, sensed, detected and identified coin elements. The counter-totalizer network output signal is received by an output indication assembly 220, the output indication assembly 220 being constructed to provide an output indication in the form of an electrical signal or mechanical type of output signal or a combination electrical-mechanical output signal upon receiving the counter-totalizer network output signal indicating that a preset, predetermined coin element or number of coin elements having a predetermined total monetary value have been deposited through the coin receiving assembly 12 and passed through the coin sensor assembly 10.

In one operational embodiment, for example, the coin sensor assembly 10 and coin receiving assembly 12 of the present invention are utilized in connection with a coin operated type of telephone, the coin receiving assembly 12 being constructed to receive coins deposited via an individual and the coin sensor assembly 10 being constructed to sense, detect and identify the deposited coins and produce an output signal indication indicating that a coin or coins of a predetermined monetary value have been received via the coin receiving assembly 12 and sensed, detected and identified via the coin sensor assembly 10. In the coin operated telephone example and assuming the coin operated telephone is to be utilized to accept coins of United States currency, the coin sensor assembly 10 and the voltage band discriminator network 206 would be constructed to sense and identify coins of United States currency having monetary values equivalent to nickels, dimes and quarters, for example. The decoder output signal or signals connected to the counter-totalizer network 216 in this operational example would each indicate that a nickel, a dime or a quarter has passed through the coin sensor assembly 10 and produced a coin sensor assembly output signal and corresponding amplified output signal having a voltage level falling within the accepted tolerance band of the voltage band discriminator network 206. The counter-totalizer network 216 counting and totalizing the output signals from the decoder 212 and providing the counter-totalizer network output signal indicative of the total monetary value of the coins deposited and passed through the coin sensor assembly 10.

The output indication assembly 220 in this coin operated telephone example would be in the nature of an electrical-mechanical output indication ultimately providing a dial tone or indication to an operator that a predetermined monetary value of coins have been deposited via the user through the coin receiving assembly 12. From the foregoing, it will be apparent to those skilled in the art that the method and apparatus of the present invention is utilized in cooperation with a coin vending type of coin handling apparatus in a manner similar to that described above with respect to a coin operated telephone application.

The apparatus of the present invention can thus be easily calibrated to accept various coin elements of United States and foreign currency via establishing the various tolerance bands, each indicative of a predetermined coin element to be accepted via the apparatus in any particular operational embodiment thereof. Further, since the tolerance bands are virtually independent of the size and the weight of the coin elements determined to be accepted, a particular operational embodiment of the present invention can be altered to accept different predetermined coin elements by merely adjusting and calibrating the tolerance bands to correspond to the different accepted coin elements, assuming coin path width 48 and coin path length 46 are each of a sufficient size such that the different coin elements will pass freely therethrough and the cross-sectional area of the largest cross-sectional area coin element is smaller than the cross-sectional area of the permanent magnet 84 and the cross-sectional area of the pole extension magnet 96 of the particular operational embodiment.

The apparatus of the present invention also functions to sense, detect and identify deposited coin elements via the coin sensor assembly 10 in a manner requiring no moving mechanical parts, thereby substantially reducing various calibration and maintenance problems. Further, since the apparatus of the present invention utilizes the coin element metallurgical structure influence on an established magnetic field to sense, detect and identify the coin element, the apparatus of the present invention is capable of discriminating between coin elements having identical diameters, identical widths, and identical weights; but, consisting of different metallurgical compositions, thereby substantially reducing the possibility of accepting counterfeit coin elements. Since the coin sensor assembly output signal is electrical in nature, the coin sensor assembly output signal can be directly connected to various electrical and electronic networks for providing perceivable output indications indicative of the deposited coin element and indicative of the total monetary value of a plurality of deposited coin elements useful which may be desirable in some operational embodiments of the present invention such as in coin vending machines, coin operated telephones and the like, for example.

DESCRIPTION OF FIG. 7

Figure 7:
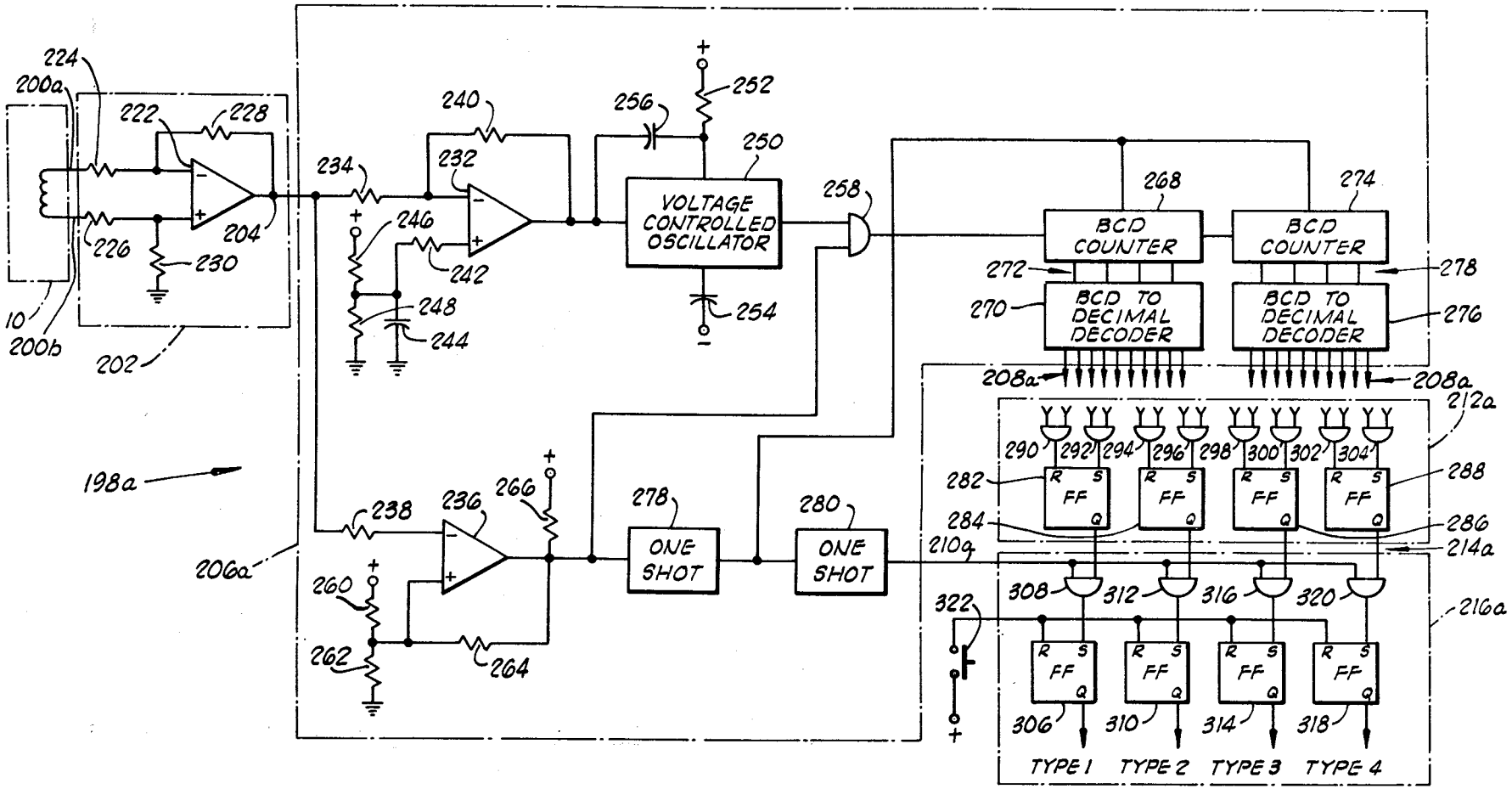
FIG. 7 is a schematic view of the coin sensor assembly of the present invention connected to a coin sensor control netowrk for identifying each deposited coin element and providing an output identification thereof.

Shown in FIG. 7 is a coin sensor control network 198*a* constructed to operate in substantially the same manner as the coin sensor control network 198 shown in FIG. 6 and described generally above, except that the coin sensor control network 198*a* is responsive to the total voltage induced by a coin 16 and thus may be characterized as impulse discriminating rather than voltage band discriminating. The amplifier network 202 is connected to receive the coin sensor assembly output signal via the signal paths 200*a* and 200*b*. More particularly, the amplifier network 202 has an op amp 222, the negative input terminal of which is connected to the signal path 200*a* via a current limiting resistor 224 and the positive input terminal of which is connected to the signal path 200*b* via a current limiting resistor 226. The negative input terminal of the op amp 222 is also connected to the output terminal thereof via a feedback resistor 228, while the positive input terminal thereof is connected to the system ground via a biasing resistor 230. As will be clear to those skilled in the art, the op amp 222 operates to receive the coin sensor assembly output signal from the coin sensor assembly 10 and provide an amplified signal via the signal path 204 which is proportional to the received coin sensor assembly output signal.

An impulse discriminator network 206*a* receives the amplified signal provided by the amplifier 202 via the signal path 204. More particularly, the impulse discriminator network 206*a* has an op amp 232, the negative input terminal of which is connected to the signal path 204 via a first voltage dividing resistor 234, and a voltage comparator 236, the negative input terminal of which is connected to the signal path 204 via a second voltage dividing resistor 238. The op amp 232 has the negative input terminal thereof connected to the output thereof via a feedback resistor 240, while the positive input terminal thereof is connected to the system ground via a resistor 242 connected in series with a capacitor 244, the junction between the resistor 242 and the capacitor 244 being connected to the positive operating potential via a resistor 246 and to the system ground via a resistor 248.

The op amp 232 has the output terminal thereof connected to the input terminal of a voltage controlled oscillator 250. The voltage controlled oscillator 250 has a first control terminal connected to the positive operating potential via a timing resistor 252 and a second control terminal connected to the negative operating potential via a timing capacitor 254. A feedback control capacitor 256 is connected between the first control terminal and the input terminal of the voltage controlled oscillator 250 to prevent parasitic oscillations thereof. As will be clear to those skilled in the art, the op amp 232 operates to receive the amplified signal provided via the signal path 204 and provide an amplified signal for application to the voltage controlled oscillator 250. As will be further clear to those skilled in the art, the voltage controlled oscillator 250 receives the amplified signal provided by the op amp 232 and provides a time related series of digital type output pulses for application to an AND gate 258, the frequency of the pulses being substantially linearly proportional to the amplitude or voltage of the received amplified signal. Thus, the op amp 232 and the voltage controlled oscillator 250 cooperate to convert the coin sensor assembly output signal received via the amplifier network 202 from a linear form to a digital form.

The voltage comparator 236 has the positive input terminal thereof connected to the positive operating potential via a first voltage reference resistor 260, to the system ground via a second voltage reference resistor 262, and to the output terminal thereof via a feedback resistor 264. The output terminal of the comparator 236 is also connected to the positive operating potential via a resistor 266. As will be clear to those skilled in the art, the voltage comparator 236 operates to provide a substantially digital type trigger signal in the high state for application to the AND GATE 258 only when the coin sensor assembly output signal provided via the amplifier network 202 and the voltage dividing resistor 238 exceeds a noise threshold as established by the voltage reference resistors 260 and 262 in a conventional manner. In the preferred embodiment, the noise threshold is selected so that the voltage comparator 236 provides the trigger signal in the high state only when the coin sensor assembly output signal exceeds a single predetermined voltage level. If desired, separate noise thresholds may be established for the leading and trailing edges of the coin sensor assembly output signal.

The voltage controlled oscillator output signal and the trigger signal are each received by the AND gate 258, which operates in a conventional manner to apply the voltage controlled oscillator output signal to a units BCD counter 268 in response to receiving the trigger signal in the high state. The units BCD counter 268 has the BCD output terminals thereof connected in a conventional manner to a units BCD-to-decimal decoder 270 via a general signal path 272, and the carry output terminal thereof connected to the input terminal of a tens BCD counter 274. The tens BCD counter 274 has the BCD output terminals thereof connected in a conventional manner to a tens BCD-to-decimal decoder 276 via a general signal path 276. The units BCD-to-decimal decoder 270 and the tens BCD-to-decimal decoder 276 have the decimal output terminals thereof connected to a general signal path 208*a*. As will be clear to those skilled in the art, the BCD counters 268 and 274 cooperate with the BCD-to-decimal decoders 270 and 276 to count or integrate the number of pulses provided by the voltage controlled oscillator 250 via the AND gate 258 under the control of the voltage comparator 236 and provide an impulse integration signal via the signal path 208*a* having a value ranging between 0 and 99.

The trigger signal is also connected to a first retriggerable monostable multivibrator or one shot 278 which operates in a conventional manner to provide a reset signal in the high state in response to receiving the trigger signal in the high state, the first one shot 278 maintaining the reset signal provided thereby in the high state for a first predetermined time period after the trigger signal switches from the high state to the low state. The reset signal is received by the BCD counters 268 and 274 which operate in a conventional manner to reset the counts contained therein to zero in response to receiving the reset signal in the low state. Thus the first one shot 278 cooperates with the voltage comparator 236 to reset the BCD counters 268 and 274 a predetermined time period after the coin sensor assembly output signal has dropped and remained below the noise threshold.

The reset signal is also received by a second retriggerable monostable multivibrator or one shot 280 which operates in a conventional manner to provide an integration complete signal in the high state via a signal path 210*a* in response to receiving the reset signal in the low state, the second one shot 280 maintaining the integration complete signal in the high state for a second predetermined time period after the reset signal switches from the high state to the low state.

A decoder network 212*a* is comprised generally of a type-one flip-flop 282 a type-two flip-flop 284, a type-three flip-flop 286, and a type-four flip-flop 288, each of the flip-flops 282 through 288 being of the RS type. The type-one flip-flop 282 has the reset input thereof connected to one of the output signals provided by the units BCD-to-decimal decoder 270 and to one of the output signals provided by the tens BCD-to-decimal decoder 276 via an AND gate 290; the set input thereof connected to one of the output signals provided by the units BCD-to-decimal decoder 270 and to one of the output signals provided by the tens BCD-to-decimal decoder 276 via an AND gate 292; and the Q output thereof connected to a portion of a general signal path 214*a*. As will be clear to those skilled in the art, the type-one flip-flop 282 operates to provide an output signal in the high state when the counts provided by the BCD counters 268 and 274, via the BCD-to-decimal decoders 270 and 276, is within a predetermined tolerance band between a lower impulse threshold established by the particular output signals connected to the AND gate 292 and an upper impulse threshold established by the particular output signals connected to the AND gate 290. For example, assuming that the 9-output signal provided by the units BCD-to-decimal decoder 270 and the O-output signal provided by the tens BCD-to-decimal decoder 276 are connected to the AND gate 292 and that the 7-output signal provided by the units BCD-to-decimal decoder 270 and the 1-output signal provided by the tens BCD-to-decimal decoder 276 are connected to the AND gate 290, the type-one flip-flop 282 will provide an output signal in the high state only when the count provided by the BCD counters 268 and 274 is at least nine (09) and less than 17.

The type-two flip-flop 284 has the reset input thereof connected to one of the output signals provided by the units BCD-to-decimal decoder 270 and to one of the output signals provided by the tens BCD-to-decimal decoder 276 via an AND gate 294; the set input thereof connected to one of the output signals provided by the units BCD-to-decimal decoder 270 and to one of the output signals provided by the tens BCD-to-decimal decoder 276 via an AND gate 296; and the Q output thereof connected to a portion of the general signal path 214*a*. As will be clear to those skilled in the art, the type-two flip-flop 284 operates to provide an output signal in the high state when the counts provided by the BCD counters 268 and 274, via the BCD-to-decimal decoders 270 and 276, is within a predetermined tolerance band between a lower impulse threshold established by the particular output signals connected to the AND gate 296 and an upper impulse threshold established by the particular output signals connected to the AND gate 294. For example, assuming that the 5-output signal provided by the units BCD-to-decimal decoder 270 and the 2-output signal provided by the tens BCD-to-decimal decoder 276 are connected to the AND gate 296 and that the 5-output signal provided by the units BCD-to-decimal decoder 270 and the 3-output signal provided by the tens BCD-to-decimal decoder 276 are connected to the AND gate 294, the type-two flip-flop 284 will provide an output signal in the high state only when the count provided by the BCD counters 268 and 274 is at least 25 and less than 35.

The type-three flip-flop 286 has the reset input thereof connected to one of the output signals provided by the units BCD-to-decimal decoder 270 and to one of the output signals provided by the tens BCD-to-decimal decoder 276 via an AND gate 298; the set input thereof connected to one of the output signals provided by the units BCD-to-decimal decoder 270 and to one of the output signals provided by the tens BCD-to-decimal decoder 276 via an AND gate 300; and the Q output thereof connected to a portion of the general signal path 214*a*. As will be clear to those skilled in the art, the type-three flip-flop 286 operates to provide an output signal in the high state when the counts provided by the BCD counters 268 and 274, via the BCD-to-decimal decoders 270 and 276, is within a predetermined tolerance band between a lower impulse threshold established by the particular output signals connected to the AND gate 300 and an upper impulse threshold established by the particular output signals connected to the AND gate 298. For example, assuming that the 9-output signal provided by the units BCD-to-decimal decoder 270 and the 3-output signal provided by the tens BCD-to-decimal decoder 276 are connected to the AND gate 300 and that the 7-output signal provided by the units BCD-to-decimal decoder 270 and the 4-output signal provided by the tens BCD-to-decimal decoder 276 are connected to the AND gate 298, the type-three flip-flop 286 will provide an output signal in the high state only when the count provided by the BCD counters 268 and 274 is at least 39 and less than 47.

The type-four flip-flop 288 has the reset input thereof connected to one of the output signals provided by the units BCD-to-decimal decoder 270 into one of the output signals provided by the tens BCD-to-decimal decoder 276 via an AND gate 302; the set input thereof connected to one of the output signals provided by the units BCD-to-decimal decoder 270 and to one of the output signals provided by the tens BCD-to-decimal decoder 276 via an AND gate 304; and the Q output thereof connected to a portion of the general signal path 214*a*. As will be clear to those skilled in the art, the type-four flip-flop 288 operates to provide an output signal in the high state when the counts provided by the BCD counters 268 and 274, via the BCD-to-decimal decoders 270 and 276, is within a predetermined tolerance band between a lower impulse threshold established by the particular output signals connected to the AND gate 304, and an upper impulse threshold established by the particular output signals connected to the AND gate 302. For example, assuming that the 6-output signal provided by the units BCD-to-decimal decoder 270 and the 5-output signal provided by the tens BCD-to-decimal decoder 276 are connected to the AND gate 304 and the 7-output signal provided by the units BCD-to-decimal decoder 270 and the 6-output signal provided by the tens BCD-to-decimal decoder 276 are connected to the AND gate 302, the type-four flip-flop 288 will provide an output signal in the high state only when the count provided by the BCD counters 268 and 274 is at least 56 and less than 67.

In the embodiment shown in FIG. 7, the lower and upper impulse thresholds for each of the flip-flops 282 through 288 are determined on the basis of a calibration procedure. In the calibration procedure, a large number of coins of a particular type, for example type-one, are passed through the coin sensor assembly 10 in the above described manner and a record is kept of the impulse integration counts provided by the BCD counters 268 and 274 in response to each of the plurality of coins. The lower impulse threshold for the type-one flip-flop may then be established by connecting the output signals provided by the BCD-to-decimal decoders 270 and 276 which correspond to the lowest count so produced by the plurality of coins tested. The upper impulse threshold for the type-one flip-flop 282 may be similarly established by connecting the output signals provided by the BCD-to-decimal decoders 270 and 276 corresponding to the highest count produced by the plurality of coins. The lower and upper impulse thresholds for the remaining flip-flops 284 through 288 may be established in a similar manner. However, in the event that any of the ranges defined by the lower and upper impulse thresholds for the flip-flops 282 through 288 overlap, then the operation of the voltage controlled oscillator 250 should be modified by changing the gain of the op amp 232 or the values of the resistor 252 and the capacitor 254 in order to narrow the range of counts produced by the BCD counters 268 and 274 to unique, non-overlapping ranges for the type-one, type-two, type-three and type-four coins.

The output signals provided by the flip-flops 282 through 288 via the general signal path 214*a* are received by the counter totalizer network 216*a*, only a portion of which is shown in FIG. 7. More particularly, the output signal provided by the type-one flip-flop 282 is received by a type-one memory flip-flop 306 via an AND gate 308, the output signal provided by the type-two flip-flop 284 is received by a type-two memory flip-flop 310 via an AND gate 312, the output signal provided by the type-three flip-flop 286 is received by a type-three memory flip-flop 314 via an AND gate 316, and the output signal provided by the type-four flip-flop 288 is received by a type-four memory flip-flop 318 via an AND gate 320. Each of the memory flip-flops 306 through 318 also receives the integration complete signal via the AND gates 308 through 320, respectively, and the signal path 210*a*.

In the preferred embodiment, each of the memory flip-flops 306 through 318 has the reset input thereof connected to the positive operating potential via a push button clear switch 322. As will be clear to those skilled in the art, each of the memory flip-flops 306 through 318 operates to provide an output signal via the Q outputs thereof in response to receiving an output signal from the flip-flops 282 through 288, respectively, under the control of the integration complete signal. For example, assuming that the lower and upper impulse thresholds have been established using the above described ranges and that a particular coin passing through the coin sensor assembly 10 produces a count of 43 via the BCD counters 268 and 274 and the BCD-to-decimal decoders 270 and 276, both the type-one flip-flop 282 and the type-two flip-flop 284 will be sequentially set and reset with the type-three flip-flop 286 being set and remaining set thereafter. Thus, when the integration complete signal in the high state is applied to the AND gates 308 and 312 via the signal path 210, only the type-three flip-flop 286 is providing an output signal via the general signal path 214*a*, so that path 214*a*, so that only the type-three memory flip-flop 314 is set in the counter totalizer network 216*a* indicating that a type-three coin has been detected. At any time thereafter, the memory flip-flops 306 through 318 may thereafter be manually reset by depressing the clear switch.

The coin element sensor of the present invention provides an output signal uniquely indicative of a coin element interposed in the established magnetic field, independent of the size and weight of the coin element. Further, the output signal is uniquely indicative of a particular coin element, independent of coin elements having identical weights and sizes and passing through the established magnetic field at identical velocities so long as the various coin elements have different metallurgical properties.

Changes may be made in the construction and the operation of the various parts or elements disclosed herein or in the steps of the method disclosed herein without departing from the spirit and the scope of the invention as defined in the following claims.

What is claimed is:

1. Apparatus for producing output indications indicative of coin elements and the like, comprising:

coin sensor means comprising:

a permanent magnet having a pair of oppositely-polarized magnetic poles;

a pole extension magnet spaced a predetermined distance from one pole of the permanent magnet, the spacing between the pole extension magnet and the permanent magnet forming a portion for receiving the coin elements and the like, the permanent magnet magnetically polarizing the pole extension magnet to substantially the same magnetic polarity as said one pole of the permanent magnet to establish a magnetic field between the permanent magnet and the pole extension magnet, the magnetic field being changed via an interposed coin element and the like; and a sensor coil having a predetermined number of ampere-turns disposed about a portion of the pole extension magnet, the magnetic field change caused via the interposed coin element and the like inducing an electromotive force in the sensor coil thereby providing an output signal uniquely indicative of the interposed coin element and the like; and means guiding the coin elements and the like into the magnetic field of the coin sensor means.

2. The apparatus of claim 1 wherein the cross-sectional area of the portions of the permanent magnet and the portions of the pole extension magnet forming the space receiving coin elements and the like each are defined further as being at least as large as the predetermined largest cross-sectional area coin element and the like to be indicated via the coin sensor means.

3. The apparatus of claim 1 defined further to include:

means establishing a tolerance band generally between a predetermined maximum sensor coil output signal and a predetermined minimum sensor coil output signal, means for receiving the sensor coil output signal and providing an output valid signal indicating a received sensor coil output signal within the tolerance band and providing an output invalid signal indicating a received sensor coil output signal outside the tolerance band; and means receiving the output valid signals and providing an output signal indicating the total monetary value of the coin elements and the like sensed via the coin sensor means.

4. The apparatus of claim 1 wherein the means guiding coin elements and the like into the magnetic field of the coin sensor means is defined further to include:

a housing, having a coin receiving end, a coin exit end and a coin path formed therein extending generally between the coin receiving end and the coin exit end, the coin path being of a size allowing coin elements and the like to pass therethrough; and wherein the coin sensor means is defined further as being connected to the housing, the portion of the coin sensor means receiving coin elements and the like forming a portion of the coin path.

5. The apparatus of claim 4 wherein the housing is constructed of a non-ferrous material and a pair of aligned openings are formed through portions of the housing, each aligned opening extending generally transversely to and intersecting the coin path; and wherein the permanent magnet includes a north pole end portion disposed in one of the aligned openings and extending generally parallel to the coin path; and wherein the pole extension magnet includes one end disposed in the aligned opening, generally opposite the north pole end portion of the permanent magnet, the end of the pole extension magnet disposed in the aligned opening extending generally parallel to the coin path.

6. The apparatus of claim 5 defined further to include:

a casing encompassing the portions of the permanent magnet extending from the opening in the housing in a direction generally away from the coin path, the casing providing a positive electromagnetic shield;

a casing encompassing the portions of the pole extension magnet extending from the opening in the housing in a direction generally away from the coin path, the casing providing a positive electromagnetic shield; and means grounding the first-mentioned and the last-mentioned casings.

7. The apparatus of claim 4 wherein the coin path in the housing includes a portion engaging the coin elements and the like prior to guiding the coin elements and the like within the coin sensor means magnetic field controlling the force and the velocity of the coin elements and the like passing through the coin sensor means magnetic field.

8. The apparatus of claim 4 defined further to include:

a coin entry detector constructed of a permanent magnet type of material having a portion disposed about a portion of the coin path generally near the coin receiving end of the housing substantially preventing the entry of slug type coin elements of the type affected via a permanent magnet type of material.

9. Apparatus for producing output indications indicative of coin elements and the like, comprising:

coin sensor means comprising:

a permanent magnet having a pair of oppositely-polarized magnetic poles;

a pole extension magnet spaced a predetermined distance from one pole of the permanent magnet, the spacing between the pole extension magnet and the permanent magnet forming a portion for receiving the coin elements and the like, the permanent magnet magnetically polarizing the pole extension magnet to substantially the same magnetic polarity as said one pole of the permanent magnet to establish a magnetic field between the permanent magnet and the pole extension magnet, the magnetic field being changed via an interposed coin element and the like; and a sensor coil having a predetermined number of ampere-turns disposed about a portion of the pole extension magnet, the magnetic field change caused via the interposed coin element and the like inducing an electromotive force in the sensor coil thereby providing an output signal uniquely indicative of the interposed coin element and the like;

means guiding the coin elements and the like into the magnetic field of the coin sensor means; and means establishing a tolerance band generally between a predetermined lower impulse threshold and a predetermined upper impulse threshold, said means receiving and integrating the sensor coil output signal and providing an output signal indicating a received sensor coil output signal within the tolerance band.

10. The apparatus of claim 9 wherein the means establishing the tolerance band is further defined as integrating the received coin sensor output signal when the received coin sensor output signal exceeds a predetermined threshold.

11. A method for detecting and sensing coin elements and the like and providing output indications indicative of the sensed coin elements and the like, the method comprising the steps of:

establishing a magnetic field between a permanent magnet and a pole extension magnet, the magnetic field having a constant magnetic field strength;

passing coin elements and the like through the magnetic field, the coin elements and the like having predetermined metallurgical compositions changing the flux intensity of the established magnetic field when interposed therein; and sensing the flux intensity change induced in the pole extension magnet by the passage of the coin elements and the like and producing an output signal in response thereto, the output signal being uniquely indicative of the coin element and the like interposed in the established magnetic field.

12. The method of claim 11 defined further to include the steps of:

establishing a predetermined tolerance band between a predetermined maximum output signal and a predetermined minimum output signal for each of a predetermined number of accepted coin element types;

receiving the output signals resulting from coin elements passing through the magnetic field; and producing output valid signals in response to received output signals within one of the predetermined tolerance bands.

13. The method of claim 12 defined further to include the steps of:

identifying the monetary value of each coin element via the predetermined tolerance bands utilized to produce each of the output valid signals; and providing an output indication indicative of each identified monetary value of each coin element.

14. The method of claim 13 defined further to include the steps of:

receiving the output indications indicative of each identified monetary value of each coin element and totalizing the monetary values of a predetermined number of coin elements; and providing an output indication indicative of the total monetary value of the predetermined number of coin elements.

15. The method of claim 11 wherein the step of producing the output signal is defined further to include:

producing the output signal uniquely indicative of the coin element interposed in the established magnetic field, independent of the size and weight of the coin element.

16. The method of claim 15 wherein the step of producing the output signal is defined further as producing the output signal uniquely indicative of a particular coin element, independent of coin elements having identical weights and sizes and passing through the established magnetic field at identical velocities, but having different metallurgical properties.

17. Apparatus for producing output indications indicative of coin elements and the like, comprising:

coin sensor means comprising:

a permanent magnet having a pair of oppositely-polarized magnetic poles;

a pole extension magnet spaced a predetermined distance from one pole of the permanent magnet, the spacing between the pole extension magnet and the permanent magnet forming a portion for receiving the coin elements and the like, the permanent magnet magnetically polarizing the pole extension magnet to substantially the same magnetic polarity as said one pole of the permanent magnet to establish a magnetic field between the permanent magnet and the pole extension magnet, the magnetic field being changed via an interposed coin element and the like; and a sensor coil having a predetermined number of ampere-turns disposed about a portion of the pole extension magnet, the magnetic field change caused via the interposed coin element and the like inducing an electromotive force in the sensor coil thereby providing an output signal uniquely indicative of the interposed coin element and the like;

means guiding the coin elements and the like into the magnetic field of the coin sensor means;

an amplifier receiving and amplifying the output signal from the sensor coil of the coin sensor means and providing an amplified output signal proportional to the received output signal from the coin sensor means;

means receiving the amplified output signal and providing an output signal in a digital form in response to the received amplified output signal;

a voltage comparator receiving the amplified output signal and providing a trigger signal in a high state in response to a received amplified output signal exceeding a predetermined noise threshold;

gate means receiving the output signal in the digital form and the trigger signal provided via the voltage comparator and providing the received output signal in the digital form in response to receiving the trigger signal in the high state;

means for receiving the output signal in the digital form provided via the gate means and counting the number of pulses in the received output signal from the gate means in the high state of the trigger signal and providing an impulse integration signal indicative of the number of pulses counted;

a decoder network receiving the impulse integration signal and providing an output signal in a high state in response to receiving an impulse integration signal within a predetermined tolerance band between a lower impulse threshold and an upper impulse threshold; and means receiving the output signal from the decoder network and providing an output signal in response to receiving a decoder network output signal indicating an impulse integration signal within the predetermined tolerance band.

* * * * *